US005360565A

United States Patent [19]

Junga

[11] Patent Number: 5,360,565

[45] Date of Patent: Nov. 1, 1994

[54] HYDRAULIC OIL

[75] Inventor: Anthony G. Junga, Fraser, Mich.

[73] Assignee: Petro-Lube, Inc., Whitemore Lake, Mich.

[21] Appl. No.: 7,435

[22] Filed: Jan. 22, 1993

[51] Int. Cl.[5] ..... C10M 145/22

[52] U.S. Cl. ..... 252/56 R; 252/48.6; 252/52 R; 252/78.1

[58] Field of Search ..... 252/45, 48.6, 52 R, 252/56 R, 47.5, 78.1

[56] References Cited

U.S. PATENT DOCUMENTS 5,032,300 7/1991 O'Neil ..... 252/57.5 R

OTHER PUBLICATIONS

*Development of an Extended-Life Hydraulic Fluid*, by Mitsuo Okada & Masatada Yamashita, pp. 1-8, 1985.

*Primary Examiner*—Asok Pal
*Assistant Examiner*—P. Achutamurthy
*Attorney, Agent, or Firm*—Dykema Gossett PLLC

[57] ABSTRACT

An improved anti-wear, high pressure hydraulic oil which contains essentially no zinc or phosphorous is described. The hydraulic oil protects against corrosion and oxidation as well as provides anti-wear, anti-weld, and demulsibility properties. This improved hydraulic oil contains (1) petroleum hydrocarbon oil; (2) esters of dibasic and monobasic acids; (3) butylated phenol; (4) phenol; (5) sulfurized fatty oil; (6) fatty acid; and (7) sulfur scavenger. This hydraulic oil has a reduced tendency towards sludge formation and has, therefore, an increased lifetime. This hydraulic oil can be used in applications requiring good boundary lubrication and minimal sludge formation. It is especially useful in high pressure hydraulic systems and pumps.

18 Claims, No Drawings

HYDRAULIC OIL

FIELD OF THE INVENTION

This invention relates to an improved hydraulic oil as well as hydraulic systems using this improved hydraulic oil. More specifically, the improved hydraulic oil of this invention is an anti-wear, high pressure hydraulic oil which contains essentially no zinc or phosphorous. The present hydraulic oil protects against corrosion and oxidation as well as provides anti-wear, anti-weld, and demulsibility properties. The improved hydraulic oil of the present invention can be used in applications requiring good boundary lubrication and minimal sludge formation. This present hydraulic oil is especially useful in high pressure hydraulic systems and pumps.

BACKGROUND OF THE INVENTION

Hydraulic systems employing hydraulic oil as the working fluid are used extensively. Additives having zinc and/or phosphorous have been used in such hydraulic oils to increase operational properties including thermal stability, oxidation stability, anti-wear properties, and the like. One especially preferred additive in hydraulic oils or fluids is zinc dialkyldithiophosphate (ZDTP). Zinc dialkyldithiophosphate can be represented by the general structure:

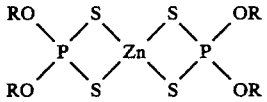

where R is an alkyl group such as, for example, octyl. These zinc dialkyldithiophosphates are viscous, sticky materials which are soluble in oil and insoluble in water. In high-zinc-type hydraulic fluids, the level of added zinc dialkyldithiophosphate is over one weight percent. In such fluids, oil sludge formation is a significant problem, especially in high pressure hydraulic systems having close tolerance parts. Low-zinc-type hydraulic fluids, having less than about 0.7 weight percent zinc dialkyldithiophosphate (generally in the range of about 0.3 to 0.5 weight percent) were developed, in part, to reduce the tendency of sludge formation. Nonetheless, sludge formation has remained a significant problem with hydraulic oils containing zinc dialkyldithiophosphate or other zinc- and phosphorous-containing additives.

Sludge formation in hydraulic oils results in a reduction in the useful life of the hydraulic oil as well as costly downtime. Such downtime can be significant, especially if the sludge clogs filters or deposits on internal surfaces of the hydraulic system.

Generally such sludge formation is not thought to be cause by deterioration of the hydraulic oil components themselves. Rather, most of the operational problems appear to result from contamination from outside the hydraulic system and the interaction of such contamination with the components of the hydraulic oil. One significant mechanism for sludge formation appears to be the reaction of aqueous contaminates with additives containing zinc and/or phosphorous. In many instances, the sludge recovered from hydraulic systems is rich in zinc- and phosphorous-containing compounds.

Hydraulic oils leaking into other systems may also clause similar problems. For example, cutting or machine tools normally employ aqueous based cutting fluids. Hydraulic oil which leaks into such cutting fluid systems can significantly reduce the useful lifetime of the cutting fluid. When the hydraulic oil leaks into the cutting fluid, the zinc dialkyldithiophosphate or other zinc- and phosphorous-containing additives can be decomposed by reaction with water to form zinc polyphosphates, water soluble phosphates, and alkyl sulphides. The phosphates appear to concentrate in the water phase of the cutting fluid and eventually to destablize the cutting fluid emulsion by forming a "sticky cream" containing metallic fines and unemulsified oil. The "sticky cream," in addition to reducing the effectiveness of the cutting fluid, can build up on machines, tools, and parts produced.

Attempts have been made to reduce the tendency of hydraulic oils containing zinc and phosphorous compounds (especially zinc dialkyldithiophosphates) to form sludges during use in a hydraulic system or when the hydraulic oil contaminates other systems. Generally, simply eliminating the zinc and phosphorous compounds from the hydraulic oil formulation is not satisfactory because of a reduction in anti-wear and other properties. Others have attempted to extend the lifetime of such fluids by removal of decomposition products using chemical treatment and vacuum filtration techniques. Such "cleaning" processes are more useful in treating fluids which become contaminated with hydraulic oils since the hydraulic oils, and thus the contaminated products, form only a relatively small proportion of the fluid to be treated. Others have used dispersants in zinc-containing hydraulic oils to help disperse the sludge formed from the zinc dialkyldithiophosphates. Such dispersants may even delay the formation of the sludge.

None of the methods of the prior art have been completely successful in providing a hydraulic oil with acceptable operational properties while minimizing the sludge formation of the hydraulic oil. It is desirable, therefore, to provide an essentially zinc-free and phosphorous-free hydraulic oil with good operational properties and minimal sludge formation properties. The present invention provides such a hydraulic oil.

SUMMARY OF THE INVENTION

In accordance with this invention, an improved hydraulic oil with essentially no zinc or phosphorous is provided. Specifically, the improved hydraulic oils of this invention do not contain zinc dialkyldithiophosphates. The present hydraulic oil protects against corrosion and oxidation as well as provides good anti-wear, anti-weld, and demulsibility properties. The improved hydraulic oil of the present invention can be used in applications requiring good boundary lubrication and minimal sludge formation. This present hydraulic oil is especially useful in high pressure hydraulic pumps.

One object of the present invention is provide a hydraulic oil with good lubrication properties and a reduced tendency towards sludge formation during use. Another object of the present invention is to provide a hydraulic oil with an extended lifetime.

Another object of the present invention is to provide an essentially zinc-free and phosphorous-free hydraulic oil composition comprising:

(1) petroleum hydrocarbon oil;
(2) polymeric ester of dibasic and monobasic acids;
(3) butylated phenol;
(4) phenol;
(5) sulfurized fatty oil;
(6) fatty acid; and (7) sulfur scavenger; wherein said composition contains essentially no zinc or phosphorous, protects against corrosion and oxidation, and provides anti-wear, anti-weld, and demulsibility properties.

Another object of the present invention is to provide an essentially zinc-free and phosphorous-free hydraulic oil composition comprising:

(1) about 70 to 99.9 weight percent petroleum hydrocarbon oil;
(2) about 0.001 to 5.0 weight percent polymeric ester of dibasic and monobasic acids;
(3) about 0.001 to 5.0 weight percent butylated phenol;
(4) about 0.001 to 5.0 weight percent phenol;
(5) about 0.001 to 5.0 weight percent sulfurized fatty oil;
(6) about 0.001 to 5.0 weight percent fatty acid; and
(7) about 0.001 to 5.0 weight percent sulfur scavenger; wherein said composition contains essentially no zinc or phosphorous.

Still another object of this invention is to provide a hydraulic system comprising a working fluid reservoir, a working fluid, a pump for moving the working fluid through the system, lines and directional valves through which the working fluid moves, a control system for controlling the movement of the working fluid within the system, and a working piston connected to the working fluid reservoir through the lines, wherein the piston is movable by action of the working fluid to produce work;

wherein the working fluid is an essentially zinc-free and phosphorous-free hydraulic oil composition containing:

(1) about 70 to 99.9 weight percent petroleum hydrocarbon oil;
(2) about 0.001 to 5.0 weight percent polymeric ester of dibasic and monobasic acids;
(3) about 0.001 to 5.0 weight percent butylated phenol;
(4) about 0.001 to 5.0 weight percent phenol;
(5) about 0.001 to 5.0 weight percent sulfurized fatty oil;
(6) about 0.001 to 5.0 weight percent fatty acid; and
(7) about 0.001 to 5.0 weight percent sulfur scavenger; wherein said composition contains essentially no zinc or phosphorous and wherein said composition protects against corrosion and oxidation and provides anti-wear, anti-weld, and demulsibility properties in the hydraulic system.

These and other objects and advantages of the present invention will become apparent through the following description of the preferred embodiments of the invention.

DESCRIPTION OF THE PREFERRED EMBODIMENTS

The present invention provides an improved hydraulic oil with significantly reduced tendency for sludge formation and, therefore, a significantly increased lifetime. The present invention also provides hydraulic systems using this improved hydraulic oil. This improved hydraulic oil is an anti-wear, high pressure hydraulic oil which contains essentially no zinc or phosphorous is provided. This hydraulic oil does not contain the zinc dialkyldithiophosphate additive normally used in conventional hydraulic oils. In spite of the absence of zinc-and/or phosphorous-containing additives, the present hydraulic oil protects against corrosion and oxidation as well as provides anti-wear, anti-weld, and demulsibility properties. The improved hydraulic oil of the present invention can be used in applications requiring good boundary lubrication and minimal sludge formation. This present hydraulic oil is especially useful in high pressure hydraulic pumps. The reduced tendency towards sludge formation should provide significantly improved lifetimes for these hydraulic oil. This reduced tendency towards sludge formation should also provide significantly increased lifetimes for other working fluids, such as cutting fluids, which may become contaminated with the hydraulic oils of this invention.

The present invention relates to an essentially zinc-free and phosphorous-free hydraulic oil composition containing (1) petroleum hydrocarbon oil; (2) polymeric ester of dibasic and monobasic acids; (3) butylated phenol; (4) phenol; (5) sulfurized fatty oil; (6) fatty acid; and (7) sulfur scavenger; wherein said composition contains essentially no zinc or phosphorous, protects against corrosion and oxidation, and provides anti-wear, anti-weld, and demulsibility properties. Preferably the compositions of this invention contain (1) about 70 to 99.9 weight percent petroleum hydrocarbon oil; (2) about 0.001 to 5.0 weight percent of a polymeric ester of dibasic and monobasic acids; (3) about 0.001 to 5.0 weight percent butylated phenol; (4) about 0.001 to 5.0 weight percent phenol; (5) about 0.001 to 5.0 weight percent sulfurized fatty oil; (6) about 0.001 to 5.0 weight percent fatty acid; and (7) about 0.001 to 5.0 weight percent sulfur scavenger. More preferably, the compositions of this invention contain (1) about 97 to 99 weight percent petroleum hydrocarbon oil; (2) about 0.1 to 1.0 weight percent of a polymeric ester of dibasic and monobasic acids; (3) about 0.1 to 1.0 weight percent butylated phenol; (4) about 0.1 to 1.0 weight percent phenol; (5) about 0.1 to 1.0 weight percent sulfurized fatty oil; (6) about 0.1 to 1.0 weight percent fatty acid; and (7) about 0.1 to 1.0 weight percent sulfur scavenger. Even more preferably, the compositions of this invention contain (1) about 97 to 99 weight percent petroleum hydrocarbon oil; (2) about 0.3 to 0.5 weight percent of a polymeric ester of dibasic and monobasic acids; (3) about 0.3 to 0.5 weight percent butylated phenol; (4) about 0.3 to 0.5 weight percent phenol; (5) about 0.3 to 0.5 weight percent sulfurized fatty oil; (6) about 0.3 to 0.5 weight percent fatty acid; and (7) about 0.3 to 0.5 weight percent sulfur scavenger. All percentages are based on the total weight of the composition.

The major component of the hydraulic oil of this invention is petroleum oil. The petroleum oils particularly useful in the present invention are solvent refined or hydrotreated paraffinic neutral petroleum oils with an International Organization for Standardization (ISO) grade of 32, 46, or 68. Mixtures of petroleum oils can be used and are generally preferred. Generally these petroleum oils consists of $C_{10}$ to $C_{22}$ hydrocarbons; lower or higher hydrocarbons may also be present.

The second component is a polymeric ester of dibasic and monobasic acids (Chemical Abstract No. 136570-85-9*). Suitable polymeric ester of dibasic or monobasic acids are formed by polymerization of dibasic or monobasic acids containing from about 5 to 18 carbon atoms (preferably 10 to 16 carbon atoms) where the ester group is an aliphatic group, such that the resulting polymeric material contains, on the average, about 150 to 250 carbon atoms. One particularly preferred polymeric ester is Syn-Ester GY-25 from Gateway Additive Company which is a high molecular weight polymerized ester.

The third and fourth components are butylated phenol (Chemical Abstract No. 128-39-2) and phenol (Chemical Abstract No. 108-95-2). One preferred source of these components is LZ-423 from Lubrizol Corporation which contains about 60 to 99 weight percent butylated phenol and about 1 to 4.0 weight percent phenol in an oil diluent.

The fifth component is a sulfurized fatty oil (Chemical Abstract No. 68990-99-8). Preferred sulfurized fatty oils contain between about 12 to 22 carbon atoms and, more preferably, about 16 to 20 carbon atoms. Mixtures of sulfurized fatty oils can also be used.

The sixth component is a fatty acid (Chemical Abstract No. 112-80-1). Preferred fatty acids contain between about 12 to 22 carbon atoms and, more preferably, about 16 to 20 carbon atoms. Single fatty acids or mixtures of fatty acids can be used.

The seventh component is a sulfur scavenger (Chemical Abstract No. 89347-09-1). Conventional sulfur scavengers normally used in hydraulic oils can be employed. One preferred sulfur scavenger is an alkylated 2,5-dimercapto 1,4-thiadiazole; preferably the alkylated portion of the thiadiazole contains between 5 and 12 carbon atoms. Mixtures of sulfur scavengers can also be used.

One preferred source of the fifth, sixth, and seventh components is Elco 318 from Elco Corporation which contains about 40 to 80 weight percent of sulfurized fatty oil, about 15 to 40 weight percent fatty acid, and about 4 to 16 weight percent sulfur scavenger.

The hydraulic oil of this invention is prepared by simply blending the various components to form a homogeneous mixture. Preferably the components are blended at about 60° to 150° F. for about 5 minutes or more until a homogeneous mixture is formed.

The hydraulic oils of this invention are essentially zinc-free and phosphorous-free. By "zinc-free" and "phosphorous-free" it is meant that zinc-containing and/or phosphorous-containing compounds are not added to the composition and that any zinc or phosphorous in the hydraulic oil are at trace levels (i.e., less than about 100 ppm and preferably less than about 1 ppm).

The hydraulic oils of this invention can be used in conventional hydraulic systems, including high-pressure hydraulic systems and pumps. Such hydraulic systems generally employ a working fluid reservoir, a working fluid, a pump for moving the working fluid through the system, lines and directional valves through which the working fluid moves, a control system for controlling the movement of the working fluid within the system, and a working piston connected to the working fluid reservoir through the lines, wherein the piston is movable by action of the working fluid to produce work. The hydraulic oils of this invention are especially useful in hydraulic systems operating at pressures greater than about 1500 psi and temperatures greater than about 130° F. The hydraulic oils of this invention are also especially useful in hydraulic systems used to operate and control cutting and machine tools where the hydraulic oil is likely to contaminate other working fluids such as cutting fluids. This hydraulic oil can also be used in other applications requiring good boundary lubrication and minimal sludge formation.

The following example is provided to illustrate the invention and not to limit the invention.

EXAMPLE

A hydraulic oil was prepared by blending 99 parts by weight of a petroleum hydrocarbon blend (about 30 percent Mobil SEN 100 and about 70 percent Mobil SEN 300), 0.4 parts by weight Syn-Ester GY-25 from Gateway Additive Co. (polymeric ester of monobasic and dibasic acids), 0.4 parts by weight LZ-423 from Lubrizol Corp. (butylated phenol with about 1–4 percent phenol), and 0.2 parts by weight ELCO-318 from Elco Corp. (about 50–70 percent sulfurized fatty oil, about 20–30 percent fatty acid, and about 5–10 sulfur scavenger). The components were blended at about 100° F. for about 10 minutes to obtain a homogenous hydraulic oil. This hydraulic oil is essentially zinc and phosphorous free.

The resulting hydraulic oil had a viscosity (ASTM D 445) of 46 centistokes at 100° F.; a flash point and fire point (ASTM D 92) of 400° F. and 435° F., respectively; a pour point (ASTM D 97) of +10° F.; and a viscosity index (ASTM D 567) of 95. The hydraulic oil was subjected to a number of performance type tests or evaluations. The hydraulic oil passed both a copper strip corrosion test (ASTM D 130) and a steel corrosion test (ASTM D 665A). The hydraulic oil had excellent oxidation stability (ASTM D 943): The ASTM D 943 evaluation requires a minimum oxidation stability of 750 hours; the present hydraulic oil had an oxidation stability of 1400 hours. The present hydraulic oil is low-foaming (ASTM D 892): The ASTM D 892 evaluation requires a maximum of 10 ml foam; the present hydraulic foam produced essentially zero foam during this test. Two hydraulic pump tests (ASTM D 2882) were carried out using this hydraulic oil. To pass this test, weight loss must be less than 125 mg. The first test employed a Vickers 104C hydraulic pump operating at 1200 rpm, 2000 psi, and 150° F.; weight loss using this hydraulic oil was 15.3 mg, indicating very good lubricating properties. The second test employed a 20VQ-8 pump operating at 1200 rpm, 2000 psi, and 175° F.; the observed weight loss was 40.2 mg, again indicating very good lubricating properties.

This hydraulic oil showed a significantly reduced tendency to form sludge when operated in a hydraulic system. After over 1400 hours operation in a hydraulic system at temperatures above 140° F., only minimal sludge formation was observed. With conventional hydraulic oils under these conditions one would normally expect to observe at least moderate sludge formation.

That which is claimed is:

1. An essentially zinc-free and phosphorous-free hydraulic oil composition comprising:

(1) about 70 to 99.9 weight percent petroleum hydrocarbon oil;

(2) about 0.001 to 5.0 weight percent polymeric ester of dibasic and monobasic acids, said polymeric ester having from about 150–250 carbon atoms;

(3) about 0.001 to 5.0 weight percent butylated phenol;

(4) about 0.001 to 5.0 weight percent phenol;

(5) about 0.001 to 5.0 weight percent sulfurized fatty oil;

(6) about 0.001 to 5.0 weight percent fatty acid; and (7) about 0.001 to 5.0 weight percent sulfur scavenger.

2. A composition as defined in claim 1, wherein said composition protects against corrosion and oxidation and provides anti-wear, anti-weld, and demulsibility properties.

3. A composition as defined in claim 2, wherein said petroleum hydrocarbon oil is solvent refined or hydrotreated paraffinic neutral petroleum oil with an ISO grade 32, 46, or 68.

4. A composition as defined in claim 3, wherein said polymeric ester of dibasic or monobasic acids is formed by polymerization of dibasic or monobasic acids containing from about 5 to 18 carbon atoms and the ester group is an aliphatic group; wherein said sulfurized fatty oil contains between about 12 to 22 carbon atoms; and wherein said fatty acid contains between about 12 to 22 carbon atoms.

5. A composition as defined in claim 4, wherein said sulfur scavenger is an alkylated 2,5-dimercapto 1,4-thiadiazole.

6. A composition as defined in claim 3, wherein said composition contains (1) about 97 to 99 weight percent petroleum hydrocarbon oil;
(2) about 0.1 to 1.0 weight percent polymeric ester of dibasic and monobasic acids;
(3) about 0.1 to 1.0 weight percent butylated phenol;
(4) about 0.1 to 1.0 weight percent phenol;
(5) about 0.1 to 1.0 weight percent sulfurized fatty oil;
(6) about 0.1 to 1.0 weight percent fatty acid; and
(7) about 0.1 to 1.0 weight percent sulfur scavenger.

7. A composition as defined in claim 4, wherein said composition contains (1) about 97 to 99 weight percent petroleum hydrocarbon oil;
(2) about 0.1 to 1.0 weight percent polymeric ester of dibasic and monobasic acids;
(3) about 0.1 to 1.0 weight percent butylated phenol;
(4) about 0.1 to 1.0 weight percent phenol;
(5) about 0.1 to 1.0 weight percent sulfurized fatty oil;
(6) about 0.1 to 1.0 weight percent fatty acid; and
(7) about 0.1 to 1.0 weight percent sulfur scavenger.

8. A composition as defined in claim 5, wherein said composition contains (1) about 97 to 99 weight percent petroleum hydrocarbon oil;
(2) about 0.1 to 1.0 weight percent polymeric ester of dibasic and monobasic acids;
(3) about 0.1 to 1.0 weight percent butylated phenol;
(4) about 0.1 to 1.0 weight percent phenol;
(5) about 0.1 to 1.0 weight percent sulfurized fatty oil;
(6) about 0.1 to 1.0 weight percent fatty acid; and
(7) about 0.1 to 1.0 weight percent sulfur scavenger.

9. A composition as defined in claim 6, wherein said composition contains (1) about 97 to 99 weight percent petroleum hydrocarbon oil;
(2) about 0.3 to 0.5 weight percent polymeric ester of dibasic and monobasic acids;
(3) about 0.3 to 0.5 weight percent butylated phenol;
(4) about 0.3 to 0.5 weight percent phenol;
(5) about 0.3 to 0.5 weight percent sulfurized fatty oil;
(6) about 0.3 to 0.5 weight percent fatty acid; and
(7) about 0.3 to 0.5 weight percent sulfur scavenger.

10. A composition as defined in claim 7, wherein said composition contains (1) about 97 to 99 weight percent petroleum hydrocarbon oil;
(2) about 0.3 to 0.5 weight percent polymeric ester of dibasic and monobasic acids;
(3) about 0.3 to 0.5 weight percent butylated phenol;
(4) about 0.3 to 0.5 weight percent phenol;
(5) about 0.3 to 0.5 weight percent sulfurized fatty oil;
(6) about 0.3 to 0.5 weight percent fatty acid; and
(7) about 0.3 to 0.5 weight percent sulfur scavenger.

11. A composition as defined in claim 8, wherein said composition contains (1) about 97 to 99 weight percent petroleum hydrocarbon oil;
(2) about 0.3 to 0.5 weight percent polymeric ester of dibasic and monobasic acids;
(3) about 0.3 to 0.5 weight percent butylated phenol;
(4) about 0.3 to 0.5 weight percent phenol;
(5) about 0.3 to 0.5 weight percent sulfurized fatty oil;
(6) about 0.3 to 0.5 weight percent fatty acid; and
(7) about 0.3 to 0.5 weight percent sulfur scavenger.

12. A hydraulic system comprising a working fluid reservoir, a working fluid, a pump for moving the working fluid through the system, lines and directional valves through which the working fluid moves, a control system for controlling the movement of the working fluid within the system, and a working piston connected to the working fluid reservoir through the lines, wherein the piston is movable by action of the working fluid to produce work;

wherein the working fluid is an essentially zinc-free and phosphorous-free hydraulic oil composition containing:

(1) about 70 to 99.9 weight percent petroleum hydraulic oil;
(2) about 0.001 to 5.0 weight percent polymeric ester of dibasic and monobasic acids, said polymeric ester having from about 150–250 carbon atoms;
(3) about 0.001 to 5.0 weight percent butylated phenol;
(4) about 0.001 to 5.0 weight percent phenol;
(5) about 0.001 to 5.9 weight percent sulfurized fatty oil;
(6) about 0.001 to 5.0 weight percent fatty acid; and
(7) about 0.001 to 5.0 weight percent sulfur scavenger; wherein said composition protects against corrosion and oxidation and provides anti-wear, anti-weld, and demulsibility properties in the hydraulic system.

13. A hydraulic system as defined in claim 12, wherein the petroleum hydrocarbon oil in the working fluid solvent is a refined or hydrotreated paraffinic neutral petroleum oil with an ISO grate 32, 46, or 68; wherein said polymeric ester of dibasic or monobasic acids in the working fluid is formed by polymerization of dibasic or monobasic acids containing from about 5 to 18 carbon atoms and the ester group is an aliphatic group; wherein said sulfurized fatty oil in the working fluid contains between about 12 to 22 carbon atoms; and wherein said fatty acid in the working fluid contains between about 12 to 22 carbon atoms.

14. A hydraulic system as defined in claim 13 wherein the sulfur scavenger is an alkylated 2,5-dimercapto 1,4-thiadiazole.

15. A hydraulic system as defined in claim 12, wherein said composition contains (1) about 97 to 99 weight percent petroleum hydrocarbon oil;
(2) about 0.1 to 1.0 weight percent polymeric ester of dibasic and monobasic acids;
(3) about 0.1 to 1.0 weight percent butylated phenol;
(4) about 0.1 to 1.0 weight percent phenol;
(5) about 0.1 to 1.0 weight percent sulfurized fatty oil;
(6) about 0.1 to 1.0 weight percent fatty acid; and (7) about 0.1 to 1.0 weight percent sulfur scavenger.

16. A hydraulic system as defined in claim 15, wherein said composition contains (1) about 97 to 99 weight percent petroleum hydrocarbon oil;

(2) about 0.3 to 0.5 weight percent polymeric ester of dibasic and monobasic acids;

(3) about 0.3 to 0.5 weight percent butylated phenol;

(4) about 0.3 to 0.5 weight percent phenol;

(5) about 0.3 to 0.5 weight percent sulfurized fatty oil;

(6) about 0.3 to 0.5 weight percent fatty acid; and (7) about 0.3 to 0.5 weight percent sulfur scavenger.

17. A hydraulic system as defined in claim 13, wherein said composition contains (1) about 97 to 99 weight percent petroleum hydrocarbon oil;

(2) about 0.1 to 1.0 weight percent polymeric ester of dibasic and monobasic acids;

(3) about 0.1 to 1.0 weight percent butylated phenol;

(4) about 0.1 to 1.0 weight percent phenol;

(5) about 0.1 to 1.0 weight percent sulfurized fatty oil;

(6) about 0.1 to 1.0 weight percent fatty acid; and (7) about 0.1 to 1.0 weight percent sulfur scavenger.

18. A hydraulic system as defined in claim 17, wherein said composition contains (1) about 97 to 99 weight percent petroleum hydrocarbon oil;

(2) about 0.3 to 0.5 weight percent polymeric ester of dibasic and monobasic acids;

(3) about 0.3 to 0.5 weight percent butylated phenol;

(4) about 0.3 to 0.5 weight percent phenol;

(5) about 0.3 to 0.5 weight percent sulfurized fatty oil;

(6) about 0.3 to 0.5 weight percent fatty acid; and (7) about 0.3 to 0.5 weight percent sulfur scavenger.

* * * * *